US008006615B1

(12) United States Patent
Allen et al.

(10) Patent No.: US 8,006,615 B1
(45) Date of Patent: Aug. 30, 2011

(54) STENCIL STAMP SET

(75) Inventors: Nancy Allen, Miami, FL (US); Zoya Hajianpour, Fort Lauderdale, FL (US)

(73) Assignee: Zoya, Inc., Fort Lauderdale, FL (US)

( * ) Notice: Subject to any disclaimer, the term of this patent is extended or adjusted under 35 U.S.C. 154(b) by 802 days.

(21) Appl. No.: 11/999,343

(22) Filed: Dec. 5, 2007

(51) Int. Cl.
*B41L 27/26* (2006.01)

(52) U.S. Cl. ..... 101/125; 101/333; 101/405

(58) Field of Classification Search ..... 101/125, 101/327, 333, 334, 405, 406
See application file for complete search history.

(56) References Cited

U.S. PATENT DOCUMENTS 3,661,078 A * 5/1972 Hammel ..... 101/125
4,048,918 A * 9/1977 Peck ..... 101/114
4,625,640 A * 12/1986 Bunger ..... 101/327
4,986,175 A 1/1991 Boehringer et al.
5,586,500 A 12/1996 Takami et al.
5,642,665 A 7/1997 Horie
5,791,252 A * 8/1998 Egan ..... 101/485
5,894,794 A 4/1999 Imamaki et al.
5,899,142 A * 5/1999 Suda et al. ..... 101/125
6,634,288 B1 * 10/2003 Imamaki et al. ..... 101/125

* cited by examiner

*Primary Examiner* — Ren Yan
(74) *Attorney, Agent, or Firm* — Ronald V. Davidge

(57) ABSTRACT

A stencil stamp includes a number of stencils having openings with various shapes, with the stencils being individually attached to a housing of the stencil stamp so that the stencils can be easily and cleanly changed. The stencil stamp also includes a cover for preventing the evaporation of ink from a pad within the stencil stamp. In a first version, a stencil and/or the cover is slid into a slot within the housing. In a second version, the housing includes a threaded surface for the attachment of a stencil and/or the cover.

3 Claims, 3 Drawing Sheets

STENCIL STAMP SET

BACKGROUND OF THE INVENTION

1. Field of the Invention

This invention relates to rubber stamps, and, more particularly, to a stencil stamp set including a stamp device and a plurality of stencils for forming a plurality of different printed patterns.

2. Summary of the Background Art

The patent literature includes a number of descriptions of stencil stamps in which a stencil, including a perforated pattern defining an image to be printed, extends across a lower surface of a pad containing ink, with the stencil and the ink pad being tied together, to move together, as the stamp is used. For example, U.S. Pat. No. 4,986,175 describes a stamp which may be provided with a number of replaceable and removable stencils, which are releasably carried on a lower surface of the ink pad, preferably by means of a band. A compressible stand-off is placed at each end of the stencil, so that the stencil and ink pad can be moved along the surface of a document into the desired position before the ink is placed against the document.

U.S. Pat. No. 5,894,794 describes a stencil stamp in which the stencil extends past edges of the ink pad being formed upward along the sides of the ink pad. The stamp unit additionally includes a skirt member attached to the ink pad with the skirt member having a substrate formed with a through-hole at its center. Guides provided on the substrate of the skirt member guide the stencil sheet, and prevent the leakage of ink from corner portions of the stencil sheet.

U.S. Pat. No. 5,642,665 describes a stencil stamp assembly having a triangularly-shaped central member with an ink pad extending across its lower surface, and a plate member extending upward and inward, along each of the sloped sides of the triangularly-shaped central member. The stencil extends along the lower surface of the ink pad and upward between the central member and the plate member at each side of the central member.

U.S. Pat. No. 5,586,500 describes a stencil stamp that is provided with a plurality of individually replaceable stencil stamp blocks, each of which includes a stencil extending under an individual ink pad and upward along the ends of the ink pad. This multi-block arrangement can be used to produce multi-color images and to allow variations to be made in an image by changing certain of the blocks.

SUMMARY OF THE INVENTION

It is a first objective of the invention to provide stencil apparatus including a number of stencils having openings with various shapes, with the stencils being attached to a housing of the stencil apparatus rather than to the ink pad so that the stencils can be easily and cleanly changed, one for another. It is a second objective of the invention to provide stencil stamp apparatus including a cover that can be placed within the apparatus, either with a stencil or without a stencil, with the cover preventing the evaporation of ink from the pad.

In accordance with a first version of the invention, stencil stamp apparatus is provided wherein the stencil stamp apparatus includes a housing, a plunger, a spring, a plurality of stencils, and an attachment structure. The housing has an upper end with an upper hole and a lower end with a lower hole. The plunger has an upper end with a handle extending through the upper hole in the housing and the lower end with a porous pad for carrying ink. The plunger is mounted to slide within the housing between an upper position and a lower position. The spring holds the plunger in the upper position. In the plurality of stencils, each stencil has an opening defining a shape to be printed. The cover is attachable to close an opening at the lower end of the housing. The attachment structure removably holds one of the stencils adjacent to the lower hole of the housing, with the porous pad being held away from a stencil within the attachment structure, with the plunger in the upper position, and against the stencil with the plunger in the lower position.

In one embodiment to the invention, the attachment structure includes a slot extending into the housing from an opening at a front side of the housing with the cover and each of the stencils, including a plate slide-able into the slot with a tab extending outward through the opening in the front side of the housing. The cover may be slide-able into the slot along with one of the stencils. The tab of the cover and the tab of the stencil may then extend outward through different portions of the opening in the front side of the housing. The housing may be rectangularly shaped.

In a second embodiment of the housing, the attachment structure includes a first threaded surface extending around the lower hole in the housing and the cover of each of the stencils comprises a web and a second threaded surface engaging the first threaded surface. The housing may be cylindrically shaped.

In a third embodiment of the invention, the attachment structure comprises a first threaded surface extending around the lower hole of the housing with each of the stencils comprising a web, a second threaded surface engaging the first threaded surface, and a third threaded surface. The cover, in this case, comprises a fourth threaded surface engaging the third threaded surface. Again, the stencil stamp apparatus may be cylindrically shaped.

DETAILED DESCRIPTION OF THE INVENTION

Figure 1:
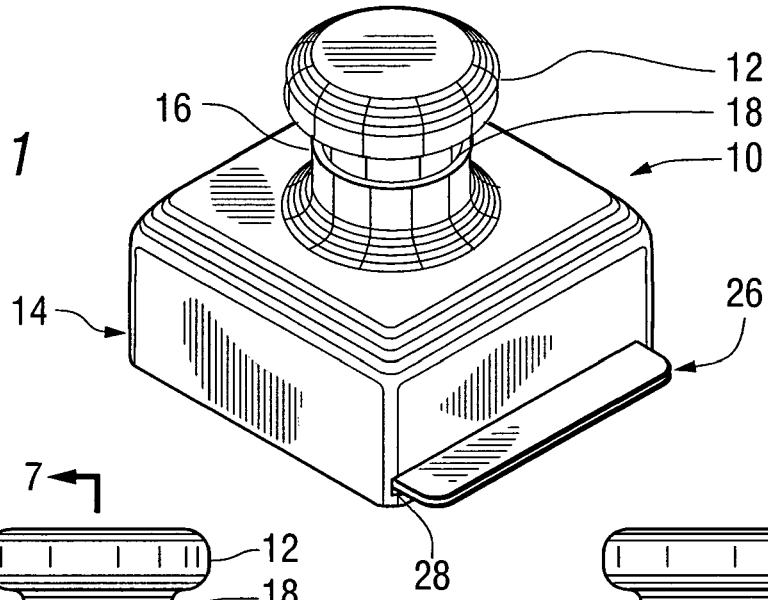
FIG. 1 is a perspective view of a stamp device built in accordance with a first embodiment of the invention.
Figure 2:
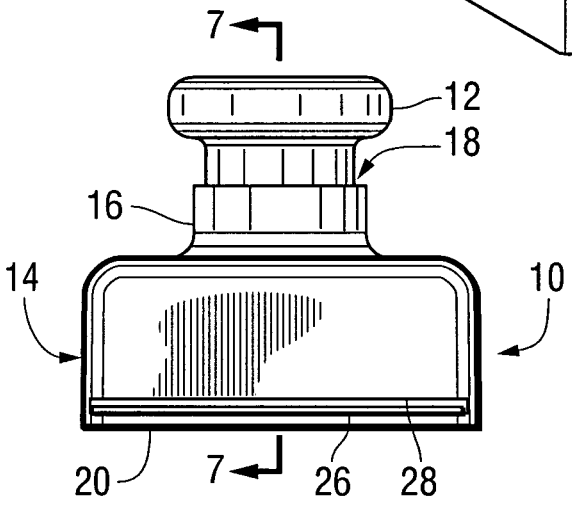
FIG. 2 is a front elevation of the stamp device of FIG. 1.
Figure 3:
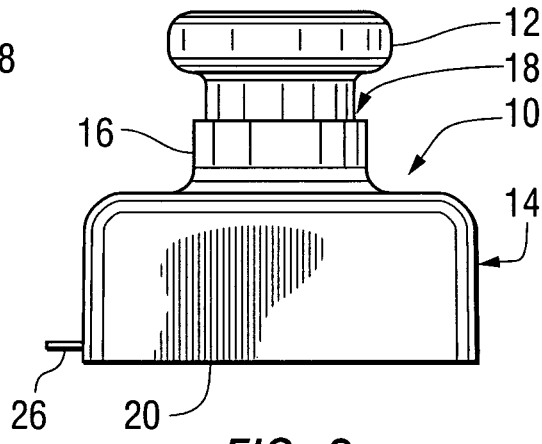
FIG. 3 is a right side elevation of the stamp device of FIG. 1.
Figure 4:
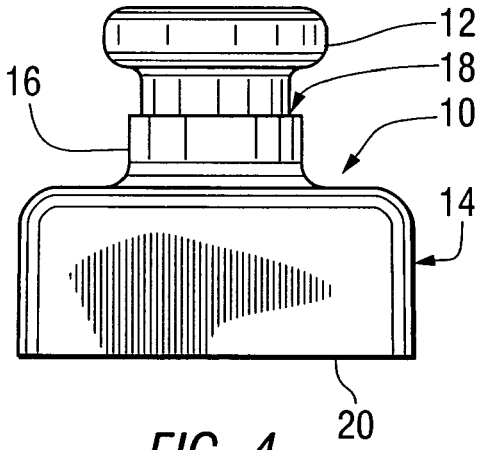
FIG. 4 is a rear elevation of the stamp device of FIG. 1.
Figure 5:
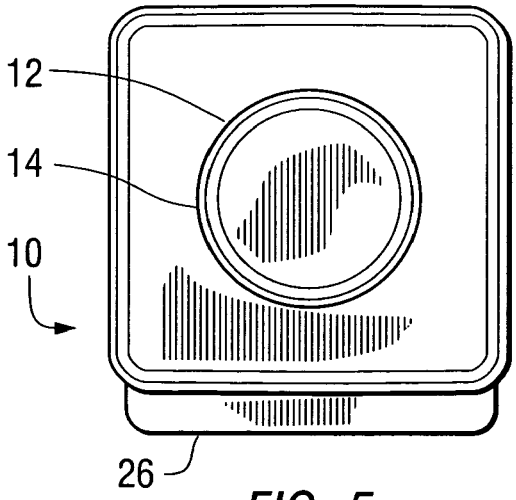
FIG. 5 is a plan view of the stamp device of FIG. 1.
Figure 6:
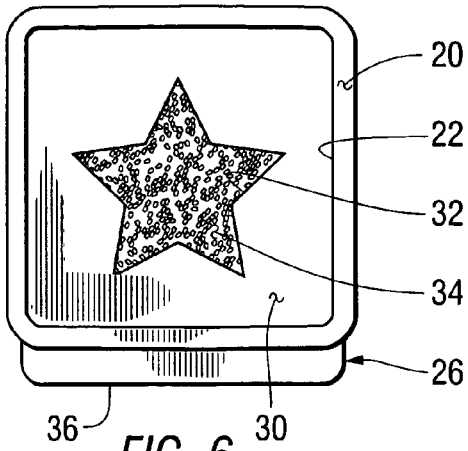
FIG. 6 is a bottom plan view of the stamp device of FIG. 1.

Various external features of a stencil stamp 10 built in accordance with a first version of the invention will now be discussed with references being made to FIGS. 1 through 6, in which FIG. 1 is a perspective view of the stencil stamp 10; FIG. 2 is a front elevation thereof; FIG. 3 is a right side elevation thereof; the left side elevation of the device is a mirror image of the right side elevation. FIG. 4 is a rear elevation thereof; FIG. 5 is a plan view thereof; and FIG. 6 is a bottom plan view thereof.

The stencil stamp 10 includes a plunger 12 mounted to slide vertically within a housing 14 which is, for example, rectangular in shape. The housing 14 includes an upper end 16 with an upper hole 18 and a lower end 20 with a lower hole 22, as shown particularly in FIG. 6. The stencil stamp 10 additionally includes a stencil 26, removably held within an attachment structure 26 in the form of a slot 28 extending within the housing 14 adjacent the lower opening. The stencil 26 includes a plate portion 30 having an opening 32 exposing a substrate (not shown) under the stencil stamp 10 to a porous ink pad 34 within the stencil stamp 10.

Figure 7:
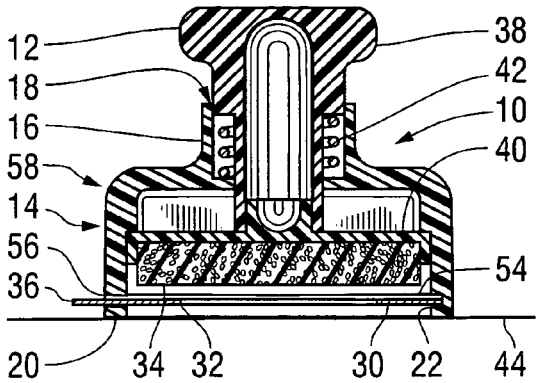
FIG. 7 is a cross-sectional side elevation of the stamp device of FIG. 1, taken as indicated by section lines 7-7 in FIG. 2.

Various internal features of the stencil stamp 10 will now be discussed with reference being made to FIG. 7, which is a cross-sectional side elevation of the stencil stamp 10, taken as indicated by section lines 7-7 in FIG. 2.

The plunger 12 is seen to comprise an upper end, having a handle 38 extending through the upper hole 18 of the housing 14 extending to hold the porous pad 34. For assembly purposes, the handle 38 and the lower end portion 40 are shown as separate pieces that are adhesively attached to form the plunger 12. The stencil stamp 12 additionally includes a coil spring 42 in an upper position, in which it is shown, with the porous pad 34 being held away from the stencil 26. Manually depressing the handle 38 of the plunger 12, moves the plunger downward into a lower position in which the porous pad 34 is held against the stencil 26 with the stencil 26 additionally being deflected downward to contact a substrate 44, such as a sheet of paper, under the stencil stamp with ink from the porous pad 34 then being transferred through the opening 32 within the stencil 26 to the substrate 44.

Figure 8:
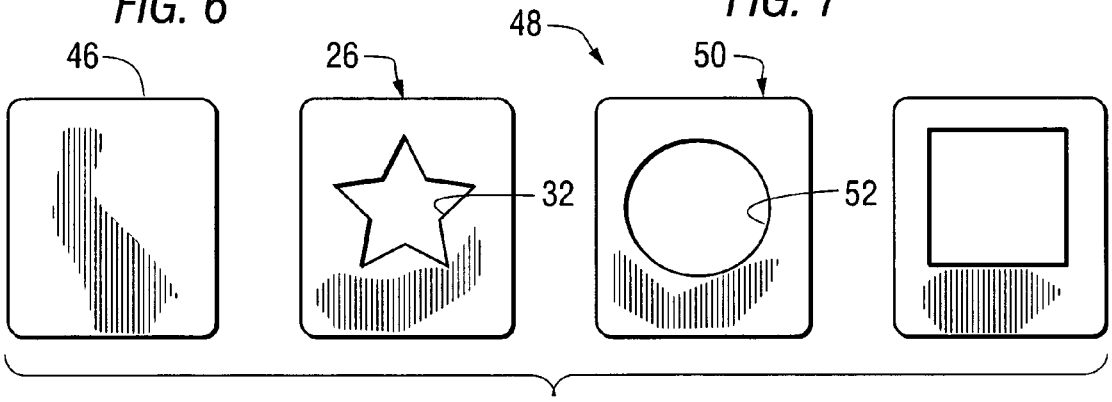
FIG. 8 is a plan view of a set of stencils and an associated cover for use within the stamp device of FIG. 1.

FIG. 8 is a plan view of a cover 46 and a set of stencils 48 including the stencil 26, as described above and additional stencils 50, having differently shaped openings 52 through which printed images can be formed. For example, the cover 46 and each of the stencils 48, may be interchangeably inserted within the slot 54 shown in FIG. 7 through an opening 56, in the front surface 58 of the housing 14. When the cover 46 is so inserted, a lower opening 22 within the housing 14 is closed to prevent the evaporation of ink held within the porous pad 34.

Figure 9:
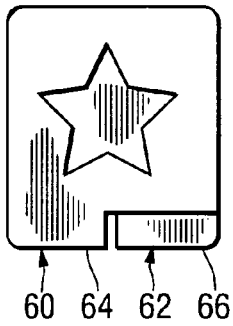
FIG. 9 is a plan view of an alternative stencil and an alternative cover for use within the stamp device of FIG. 1.

FIG. 9 is a plan view of an alternative stencil 60 placed atop an alternative cover 62 forming a configuration that can be held within the slot 54. The alternative stencil 60 and the alternative cover 62 include tab portions 64 and 66, respectively that extend through separate parts of the slot 56, shown in FIG. 7, allowing the stencil 60 and the cover 62 to be easily inserted and removed through this opening 56. This arrangement allows the cover 62 to be inserted to prevent ink evaporation without requiring the removal of the stencil 60.

Figure 10:
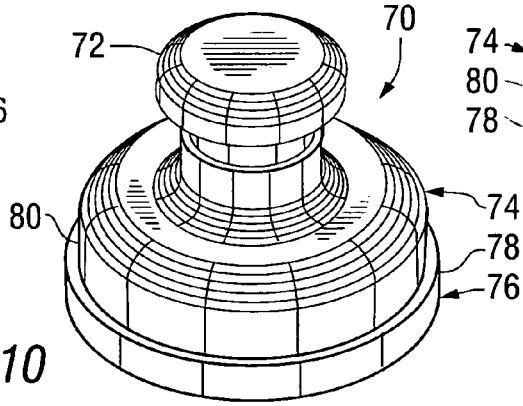
FIG. 10 is a perspective view of a stamp device built in accordance with a second embodiment of the invention.
Figure 11:
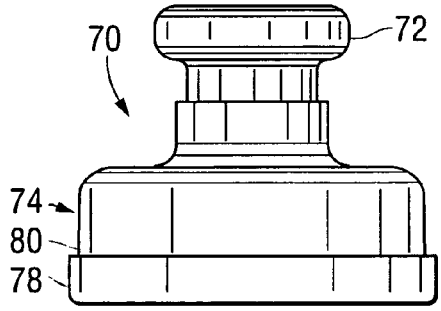
FIG. 11 is a front elevation of the stamp device of FIG. 10.
Figure 12:
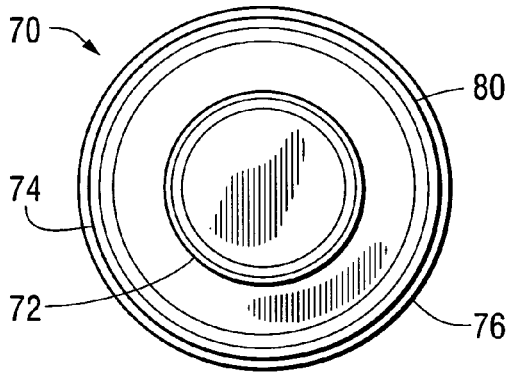
FIG. 12 is a plan view of the stamp device of FIG. 10.
Figure 13:
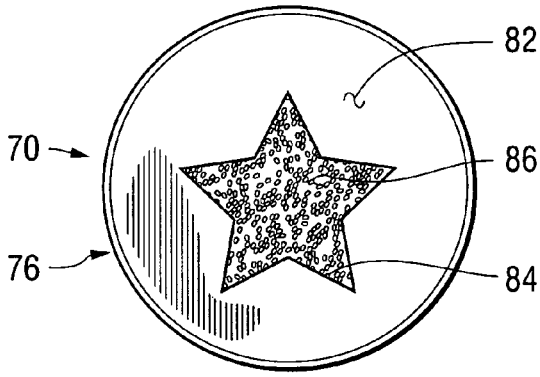
FIG. 13 is a bottom plan view of the stamp device of FIG. 10.

External features of a stencil stamp 70, built in accordance with a second embodiment of the invention, will now be discussed with reference being made to FIGS. 10-13. FIG. 10 is a perspective view of the stencil stamp 70, while FIG. 11 is a front elevation thereof, FIG. 12 is a plan view thereof; and FIG. 13 is a bottom plan view thereof. The stencil stamp 70 includes a plunger 72, a housing 74, having a cylindrical shape, and a stencil 76. The stencil 76 includes a lip 78 engaging an attachment surface 80 of the housing 74 and a web 82, including an opening 84, through which a porous ink carrying pad 86 is brought into contact with a substrate (not shown).

Figure 14:
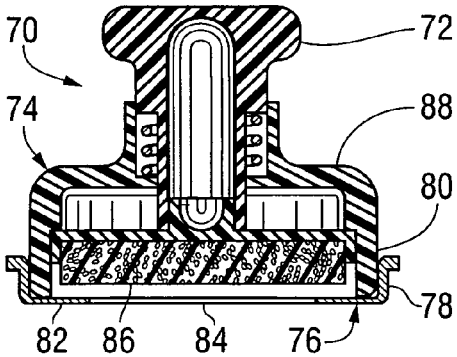
FIG. 14 is a cross-sectional side elevation of the stamp device of FIG. 10, taken as indicated by section lines 14-14 in FIG. 11.

FIG. 14 is a cross-sectional side elevation of the stencil stamp 70. The porous pad 86 and the lower portion 88 of the plunger 72 are cylindrical in shape. Other features of the stencil stamp 70 are as described above for the stencil stamp 10.

Figure 15:
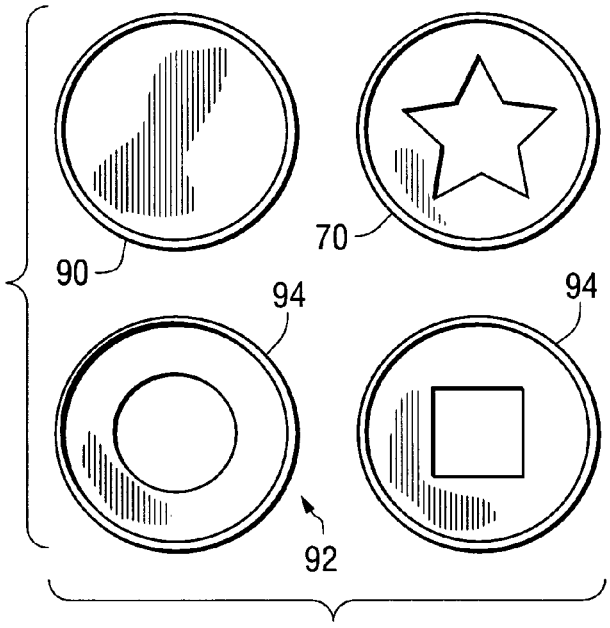
FIG. 15 is a plan view of a set of stencils and an associated cover for use with the stamp device of FIG. 10.

FIG. 15 is a plan view of a cover 90 configured for use with the stencil stamp 70 together with a set of stencils 92, including the stencil 76 described above and additional stencils 94. The stencils 76 and 94 may be individually installed on the stencil stamp 70 to produce various ink patterns on a substrate. When the stencil stamp 70 is not in use, the cover 90 is preferably installed in place of the stencils 76 and 94 to prevent the evaporation of ink stored within the porous pad 86.

Figure 16:
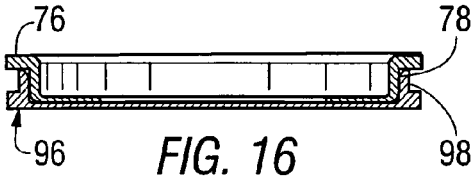
FIG. 16 is a cross-sectional side elevation of a stencil from the set of stencils of FIG. 15 attached to an alternative cover.

FIG. 16 is a cross-sectional side elevation of the stencil 76 having an alternative cover 96 attached thereto. The alternative cover 96 includes a lip 98 engaging the attachment surface 78 of the stencil 76. This configuration allows the cover 96 to be placed on the stencil 76, or removed there from, without removing the stencil 76 from the stamp device 70.

Figure 17:
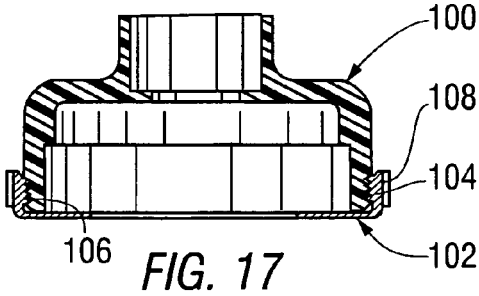
FIG. 17 is a cross-sectional side elevation of an alternative housing for a stamp device built in accordance with the second embodiment of the invention with a second alternative cover attached thereto.

FIG. 17 is a cross-sectional side elevation of an alternative housing 100 for use within the stencil stamp built in accordance with the second embodiment of the invention, engaging an alternative stencil 102. The alternative housing 100 is provided with a threaded surface 104 engaging a threaded surface 106 of the alternative stencil 102. Preferably, the alternative stencil 102 is additionally provided with a noncircular outer surface 108, having ridges or flutes to simplify the tightening and loosening of the threaded surfaces 104 and 106.

Figure 18:
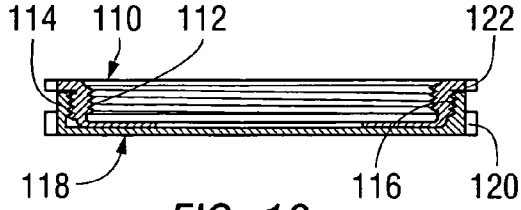
FIG. 18 is a cross-sectional side elevation of a third alternative stencil attached to a third alternative cover for use with the alternative housing of FIG. 17.

FIG. 18 is a cross-sectional side elevation of an alternative stencil 110 provided with a threaded surface 112 for engaging the threaded surface 104 of the alternative housing 100 and, additionally, with a threaded surface 114 for engaging the threaded surface 116 of an alternative cover 118. Preferably the alternative cover 118 is additionally provided with a noncircular outer surface 120, while the alternative stencil 110 is provided with a noncircular outer surface 122.

While the invention has been described in terms of preferred embodiments and versions thereof with some degree of specificity, it is understood that this description has been given only by way of example, and that many changes can be made without departing from the spirit and scope of the invention, as described in the appended claims.

What is claimed is:

1. Stencil stamp apparatus comprising:

a housing having an upper end with an upper hole and a lower end with a lower hole;

a plunger having an upper end with a handle extending through the upper hole in the housing and a lower end with a porous pad for carrying ink, wherein the plunger is mounted to slide within the housing between an upper position and a lower position;

a spring holding the plunger in the upper position;

a plurality of stencils, each having an opening defining a shape to be printed, a cover attachable to close an opening at the lower end of the housing; and an attachment structure removably holding one of the stencils adjacent the lower hole of the housing, wherein the porous pad is held away from a stencil within the attachment structure with the plunger in the upper position and against the stencil with the plunger in the lower position, wherein the attachment structure comprises a slot extending into the housing from an opening at a front side of the housing, wherein the cover and each of the stencils comprises a plate slidable into the slot with a tab extending outward through the opening in the front side of the housing, and wherein the cover is slidable into the slot along with one of the stencils.

2. The stencil stamp apparatus of claim 1, wherein the tab of the cover and the tab of the stencil extend outward through different portions of the opening in the front side of the housing.

3. The stencil stamp apparatus of claim 2, wherein the housing is rectangularly shaped.

* * * * *